US011419793B2

(12) United States Patent
Stevens

(10) Patent No.: US 11,419,793 B2
(45) Date of Patent: Aug. 23, 2022

(54) PILL SORTING APPARATUS

(71) Applicant: Robert Stevens, Lexington, MA (US)

(72) Inventor: Robert Stevens, Lexington, MA (US)

( * ) Notice: Subject to any disclaimer, the term of this patent is extended or adjusted under 35 U.S.C. 154(b) by 260 days.

(21) Appl. No.: 16/850,270

(22) Filed: Apr. 16, 2020

(65) Prior Publication Data

US 2021/0322274 A1 Oct. 21, 2021

(51) Int. Cl.

| | |
|---|---|
| ***A61J 7/04*** | (2006.01) |
| ***A61J 7/00*** | (2006.01) |
| ***A61J 1/03*** | (2006.01) |
| ***G07F 17/00*** | (2006.01) |
| ***B07C 5/02*** | (2006.01) |
| ***B07C 5/36*** | (2006.01) |

(52) U.S. Cl.

CPC ..... *A61J 7/0427* (2015.05); *A61J 1/03* (2013.01); *A61J 7/0084* (2013.01); *B07C 5/02* (2013.01); *B07C 5/36* (2013.01); *G07F 17/0092* (2013.01); *A61J 2200/30* (2013.01)

(58) Field of Classification Search

CPC ..... A61J 7/0427; A61J 7/0084; A61J 1/03; A61J 2200/30; B07C 5/02; B07C 5/36; G07F 17/0092

See application file for complete search history.

(56) References Cited

U.S. PATENT DOCUMENTS 3,618,559 A * 11/1971 Moe ..... A61J 7/0084 217/62
4,065,000 A 12/1977 Murton
4,221,175 A * 9/1980 Van Wingerden ..... A01C 7/04 141/141
4,398,578 A * 8/1983 Walters ..... A01C 7/16 141/238
4,420,083 A 12/1983 Baustin
4,473,156 A 9/1984 Martin
4,771,912 A * 9/1988 van Wingerden ..... A01C 7/02 221/75
5,029,726 A * 7/1991 Pendill ..... G07F 17/0092 206/538
5,372,276 A 12/1994 Daneshvar
5,884,806 A 3/1999 Boyer et al.
6,000,546 A * 12/1999 Noble ..... A61J 1/03 206/538
6,053,302 A 4/2000 Leu et al.
6,581,356 B2 * 6/2003 Kim ..... G07F 11/62 221/124
6,761,010 B1 * 7/2004 Gibson ..... A61J 7/0084 53/247
6,779,663 B1 * 8/2004 Pocsi ..... A61J 1/03 141/242
7,334,699 B2 * 2/2008 Keffeler ..... G07F 11/04 221/268

(Continued)

FOREIGN PATENT DOCUMENTS

WO WO2005090167 A3 12/2005

*Primary Examiner* — Michael Collins
(74) *Attorney, Agent, or Firm* — Richard A. Baker, Jr.

(57) ABSTRACT

A novel apparatus for allocating pills from a pharmacy pill container into a weekly pill storage container is described herein. The pill sorting apparatus is made of two parts, each with seven holes. The pills are poured into the sorting apparatus, and the two parts are shifted so that the holes align, allowing the seven pills to drop into the weekly pill storage container.

16 Claims, 7 Drawing Sheets

(56) References Cited

U.S. PATENT DOCUMENTS

| | | | | |
|---|---|---|---|---|
| 7,793,785 | B2 * | 9/2010 | Keffeler | A61J 7/04 206/532 |
| 8,068,931 | B2 * | 11/2011 | Tran | G16H 40/67 206/534 |
| 8,862,266 | B2 | 10/2014 | Van Ooyen et al. | |
| 9,095,497 | B1 | 8/2015 | Prince | |
| 9,770,391 | B2 | 9/2017 | Park | |
| 10,420,707 | B2 * | 9/2019 | Lewis | A61J 7/0084 |
| 2005/0284877 | A1 | 12/2005 | Gag | |
| 2009/0134181 | A1 * | 5/2009 | Wachman | G16H 20/13 220/200 |
| 2010/0155411 | A1 * | 6/2010 | Solari | B65D 83/04 221/87 |
| 2014/0263389 | A1 * | 9/2014 | Perozek | A61J 7/02 221/7 |

* cited by examiner

PILL SORTING APPARATUS

CROSS REFERENCE TO RELATED APPLICATIONS

This application is a priority application.

BACKGROUND

Technical Field

This disclosure relates to pharmaceutical dispensing apparatuses and in particular to devices for allocating pills for daily use.

Description of the Related Art

Weekly pill containers have been a mainstay of pharmaceutical dispensing for decades, as forgetful members of the community sought techniques for placing pills into boxes for each day that the pill is to be taken. These pill containers typically have 7 boxes, each labeled for a different day of the week. A user is to place the pills into each box once a week, and take the pills out for consumption each day.

These weekly pill containers are primarily used by the elderly, and require dexterity to remove the pills from the pharmacy container and place one pill in each box. Unfortunately, the elderly are the population with the least dexterity, as arthritis and various illnesses make the coordination of the fingers to dispense the pills difficult. A better method for transferring pills from a pharmacy container into the specific daily boxes in the weekly pill container is needed.

The present invention eliminates the issues articulated above as well as other issues with the currently known products.

SUMMARY OF THE INVENTION

A sorting apparatus for pills is described herein. The pill sorting apparatus is made up of two components, a trough and an outer sleeve. The trough has seven trough holes, uniformly spaced and equal in size, on the trough bottom of the trough. The trough has two trough side walls and an open trough top, where the trough holes are sized to hold the pills and the trough holes are spaced to align with boxes in a weekly pill container. The outer sleeve has two sleeve side walls, an open sleeve top and seven sleeve holes, uniformly spaced and of a same size as the trough holes, on the sleeve bottom of the outer sleeve. The outer sleeve is attached to the trough such that the sleeve bottom slides along the trough bottom, and the seven sleeve holes are offset from the seven trough holes in a first position and aligned with the seven trough holes in a second position.

The trough side walls could be sloped from a point on the trough walls to an edge of the trough holes. The trough may also include a reservoir at one end of the trough holes, where the reservoir is between the two trough side walls. The trough could also include a chute attached to the reservoir at the trough walls and the trough bottom, where walls of the chute angle together and a chute bottom raises upwards. In another embodiment, the trough includes a reservoir at one side of the trough, near an end hole. The two trough side walls could include tabs on the outside of the two trough side walls, and the two sleeve walls could include slots in the inside of the two sleeve walls, where the tabs slide in the slot. Alternatively, the two sleeve walls could include tabs on the outside of the two sleeve side walls and the two trough walls could include slots in an inside of the two trough walls, where the tabs slide in the slot. In some embodiments, the back end of the trough is an end wall perpendicular and connected to the two trough side walls. The sleeve bottom could further include alignment tabs beneath the sorting apparatus, there the alignment tabs are arranged to align the sorting apparatus with the weekly pill container. In some embodiments a spring connects the trough and the sleeve. The length of the sleeve walls could be less than a length of the sleeve bottom.

A method for sorting pills is also described here. The method is made up of the steps of (1) drawing an outer sleeve backward relative to a trough of an assembled pill sorter, (2) placing the pill sorter on top of a weekly pill container, (3) pouring at least seven pills into the trough from a pharmacy container, (4) shaking the pill sorter until the pills in the trough fall into trough holes located in a bottom of the trough, (5) drawing the outer sleeve forward, dropping the pills into the weekly pill container, and (6) separating the pill sorter from the weekly pill container.

The method could also include the step (4a) if there are more than seven pills in the trough, pushing the more than seven pills into a reservoir. In another embodiment, the method includes the step (4a) if there are more than seven pills in the trough, tilting the pill sorter so that the more than seven pills slide into a reservoir. The outer sleeve could be drawn backwards relative to the trough by a spring. The outer sleeve could be drawn backwards and forwards relative to the trough along a slot in side walls of the outer sleeve that hold a tab connected to walls of the trough. In another embodiment the outer sleeve is drawn backwards and forwards relative to the trough along a slot in side walls of the trough that hold a tab connected to walls of the outer sleeve.

A sorting system for pills is also described herein. The sorting system is made up of a weekly pill container with seven boxes and a pill sorter.

The pill sorter is made up of a trough and an outer sleeve. The trough has seven trough holes, uniformly spaced and equal in size, on a trough bottom of the trough. The trough has two trough side walls and an open trough top. The trough holes are sized to hold the pills and the trough holes are spaced to align with the seven boxes in the weekly pill container. The outer sleeve has two sleeve side walls, an open sleeve top and seven sleeve holes. The seven sleeve holes are uniformly spaced and of a same size as the trough holes, and located on the sleeve bottom of the outer sleeve. The outer sleeve is attached to the trough such that the sleeve bottom slides along the trough bottom, and the seven sleeve holes are offset from the seven trough holes in a first position and aligned with the seven trough holes in a second position.

The sleeve bottom could further include alignment tabs beneath the sorting apparatus, said alignment tabs arranged to align the sorting apparatus with the weekly pill container.

DETAILED DESCRIPTION OF THE INVENTION

Figure 1:
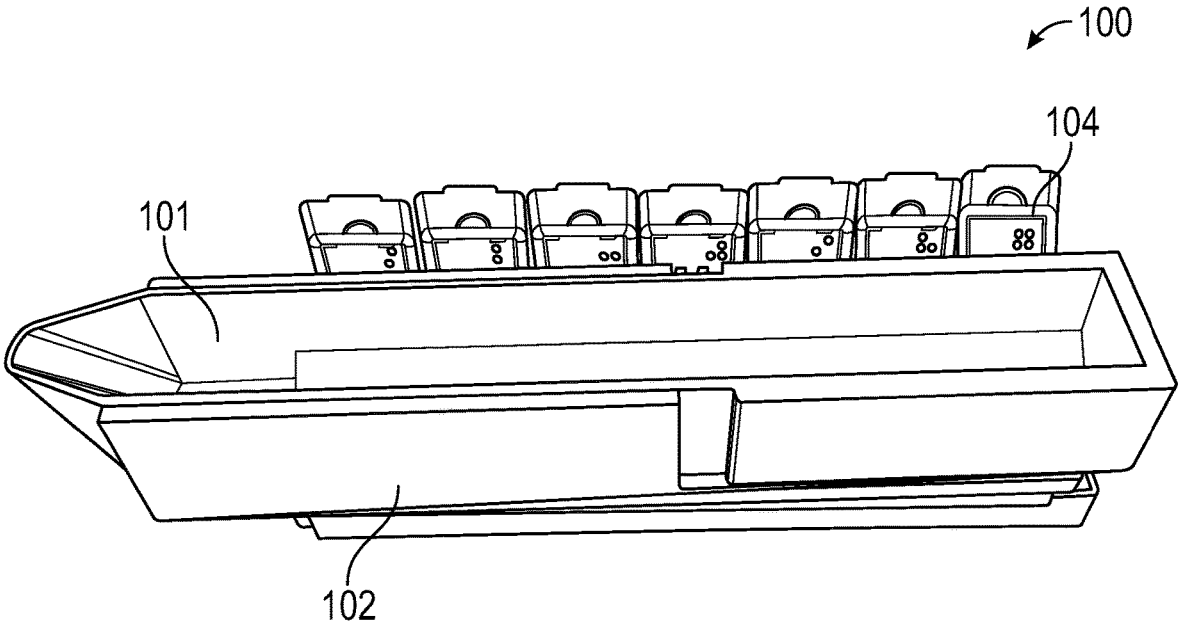
FIG. 1 shows the assembled pill sorter device on top of a weekly pill storage container.

In order to provide the elderly with an easier method of transferring pills from a pharmacy container to the daily boxes of a weekly pill container 104, a pill dispenser 100 is described here. The pill dispenser 100 sits on top of a weekly pill container 104 with the covers of the weekly pill container 104 open, as seen in FIG. 1. The pill dispenser 100 is configured with the outer sleeve 102 drawn backwards relative to the trough 101. This configuration prevents pills from falling through the trough holes 311*a-g* because the outer sleeve holes 301*a-g* are not aligned with the trough holes 311*a-g*. The user pours at least 7 pills into the pill dispenser 100 and pushes one pill into each trough hole 311*a-g*. The remaining pills are pushed to the reservoir 313. The outer sleeve 102 is then drawn forward relative to the trough 101, aligning the outer sleeve holes 301*a-g* with the trough holes 311*a-g*, thus allowing the seven pills in the trough holes 311*a-g* to drop into the 7 boxes of the weekly pill container 104. A slot 103 holds the outer sleeve 102 to the trough 101, with the trough tab 312*a-b*, also allowing the outer sleeve 102 to slide forward and backwards relative to the trough 101. When the outer sleeve 102 is drawn back such that the trough tab 312*a-b* is in back of the slot 103, the trough holes 311*a-g* do not align with the outer sleeve holes 301*a-g*, and the pills are held in the trough holes 311*a-g*. When the outer sleeve 102 is drawn forward such that the trough tab 312*a-b* is in front of the slot 103, the trough holes 311*a-g* are aligned with the outer sleeve holes 301*a-g*, and the pills drop through the trough holes 311*a-g* into the weekly pill container 104. In some embodiments, a spring is used to keep the outer sleeve 102 to the back of the trough 101. In some embodiments, the slot is in the trough walls and the tab is in the outer sleeve walls.

In some embodiments, the trough 101 in FIG. 1 has a square back end with the back wall perpendicular to and connected to the trough walls. In another embodiment, the trough 101 has a curved back end.

Figure 2:
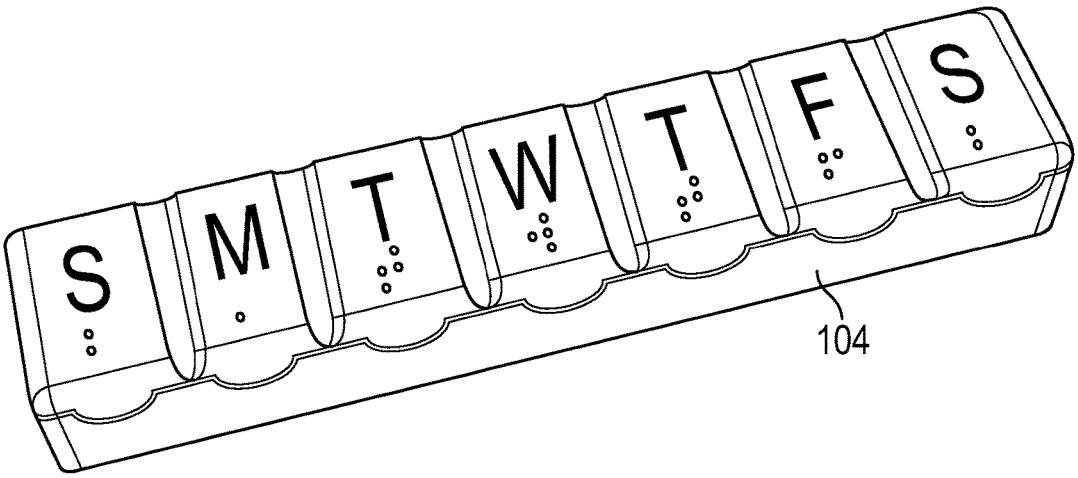
FIGURE 2 (Prior Art)
FIG. 2 shows a prior art weekly pill storage container.

FIG. 2 shows a weekly pill container 104, with seven boxes, each labeled with a day of the week, either by name, by first letter of the day name, by brail, or other indication of the day of the week. These weekly pill containers 104 are well known in the art.

Figure 3:
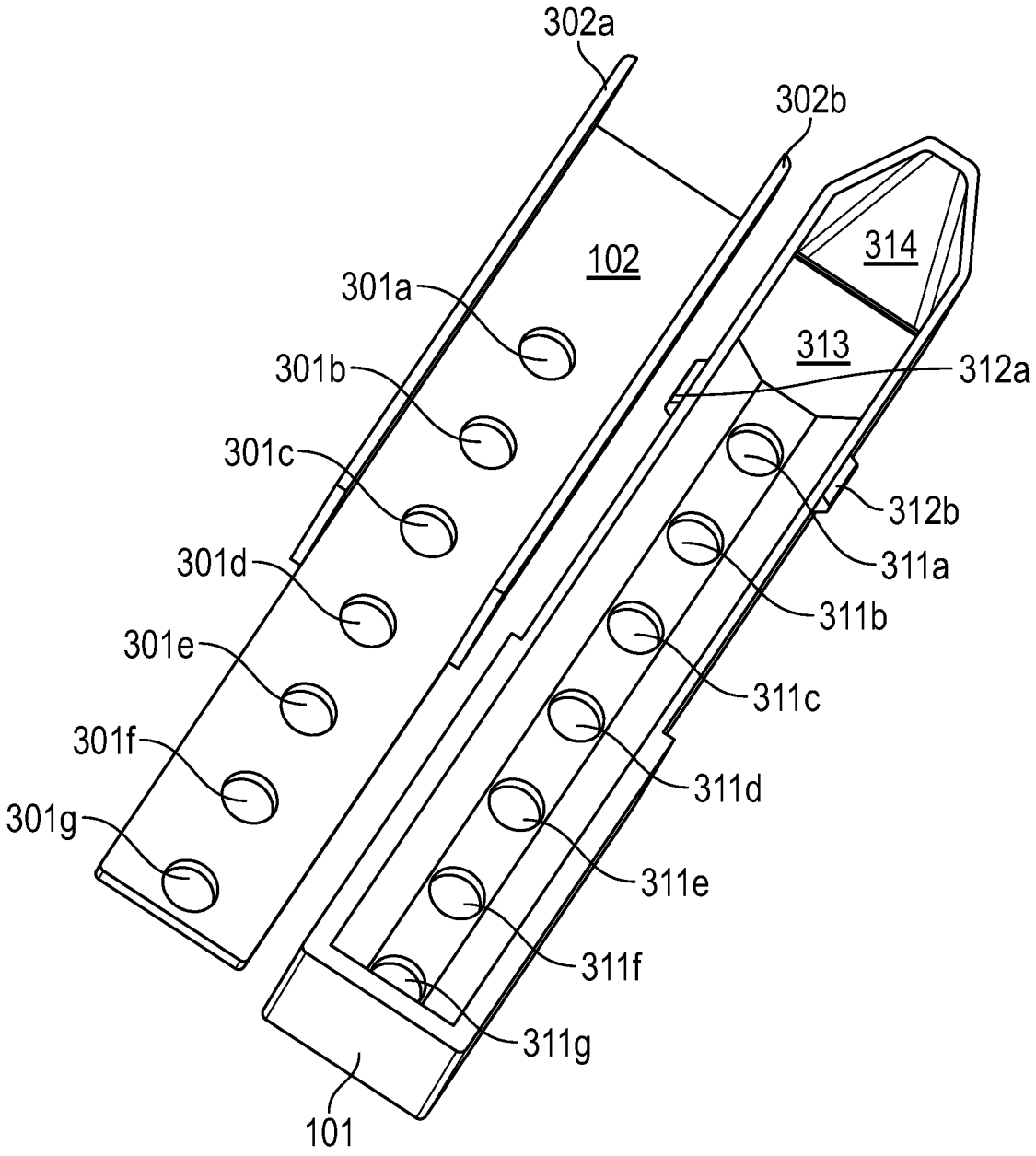
FIG. 3 is a prospective view of the two parts of the pill sorter.

FIG. 3 shows a prospective view of the two parts of the pill sorter 100, roughly aligned as when assembled. The outer sleeve 102, has two walls 302*a-b* on the long sides of the outer sleeve 102, running from the front to about two-third of the distance to the back. Different lengths of the side walls 302*a-b* are possible without deviating from the inventions herein. The outer sleeve 102 has seven outer sleeve holes 301*a-g* in the bottom of the outer sleeve 102. The size of these outer sleeve holes 301*a-g* varies in various embodiments to handle different sized pills. In some embodiments, there is one size of outer sleeve holes 301*a-g* for small pills, one size for large pills, and a third size for capsules. The outer sleeve holes 301*a-g* are equally spaced, and the distance between outer sleeve holes 301*a-g* is determined by the size of the boxes in the weekly pill container 104. In one embodiment, the sleeve holes 301*a-g* are round, and in another embodiment the sleeve holes 301*a-g* are oblong. In still other embodiments, the sleeve holes 301*a-g* are the shape of the pill being dispensed.

In one embodiment, the outer sleeve 102 walls are shorter than the trough 101 walls. In still another embodiment, there are no walls on the sleeve 102, and instead the sleeve 102 slides in a slot underneath the bottom of the trough 101. A tab is available for the user to hold the outer sleeve 102 steady as the trough 101 moves backwards to along the trough holes 311*a-g* with the outer sleeve holes 301*a-g*.

In another embodiment, there are no walls on the sleeve 102, and instead the sleeve 102 slides in a slot above the bottom of the trough 101, but beneath the slopes of the walls, through a slot in the back of the trough 101. A tab is available on the sleeve 102 for the user to pull or push the outer sleeve 102 as the trough 101 is held in place, to along the trough holes 311*a-g* with the outer sleeve holes 301*a-g*.

FIG. 3 further shows a perspective view of the trough 101. The trough 101 has a square back wall and side walls along each side. The trough 101 side walls have two different thicknesses. The back one-third of the trough 101 has a wall thickness of 4 mm, and the remaining two-thirds of the wall length has a thickness of 2 mm. The bottom of the walls slant downwards to the tough holes 311*a-g*, guiding the pills into the trough holes 311*a-g*. The front of the trough 101 has a reservoir 313 to hold any extra pills that have been placed in the pill sorter 100. In front of the reservoir 313 is a funnel shaped chute 314 for guiding the pills out of the reservoir 313 back into the pharmacy container. The bottom of the trough 101 has seven trough holes 311*a-g*. The size of these trough holes 311*a-g* varies in various embodiments to handle different sized pills, but are generally the same size and location as the outer sleeve holes 301*a-g*. In some embodiments, there is one size of trough holes 311*a-g* for small pills, one size for large pills, and a third size for capsules. The trough holes 311*a-g* are equally spaced, and the distance between trough holes 311*a-g* is determined by the size of the boxes in the weekly pill container 104. The trough 101 has two tabs 312*a-b* in the walls. When assembled, these tabs 312*a-b* are inserted in the slot 103 in the walls 302*a-b* of the outer sleeve 102.

Figure 4:
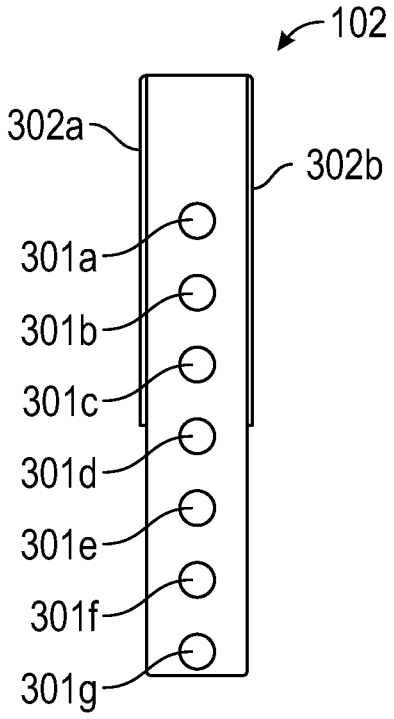
FIG. 4 shows the top view of the sliding outer sleeve of the pill sorter.
Figure 5:
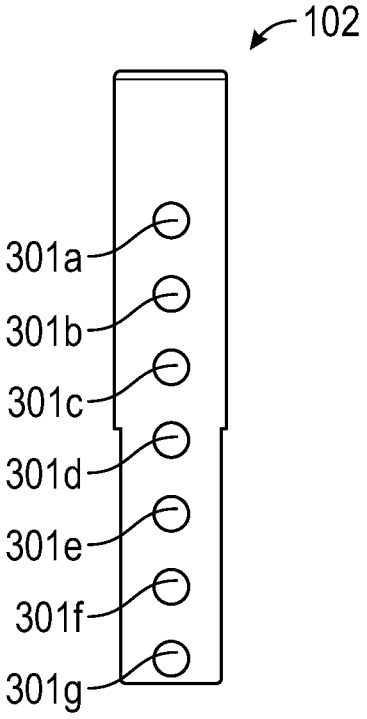
FIG. 5 shows the bottom view of the sliding outer sleeve of the pill sorter.

FIG. 4 is a top view of the outer sleeve 102. In one embodiment, the width of the outer sleeve 102 is 35 mm and the length of the base is 175.5 mm. The length of the walls 302*a-b* is 100 mm and the wall thickness is 3 mm. The walls are 25 mm high, above the base. The bottom of the outer sleeve 102 is 2 mm thick. The outer sleeve holes 301*a-g* are 10 mm in diameter and are 21.5 mm apart (center to center). The slot 103 is 20 mm in length, located on each walls about 4 mm from the top of the wall and 50 mm from the end of the wall. In some embodiments, the slot 103 goes through the wall, and in another embodiment, the slot 103 only partially goes into the inner side of the wall. FIG. 5 shows the bottom view of the outer sleeve 102. In some embodiments, the bottom of the outer sleeve 102 has alignment tabs to align the pill sorter 100 on top of the weekly pill container 104.

Figure 6:
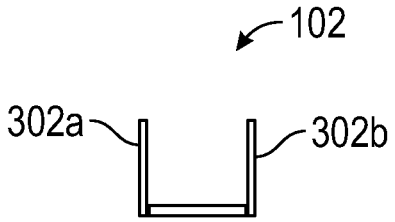
FIG. 6 shows the front view of the sliding outer sleeve of the pill sorter.
Figure 7:
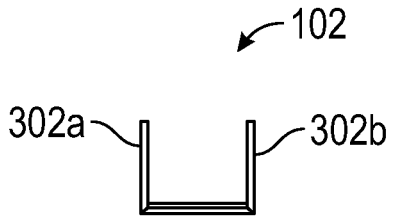
FIG. 7 shows the back view of the sliding outer sleeve of the pill sorter.

FIG. 6 shows the front view of the outer sleeve 102, showing the base and the outer sleeve walls 301*a-b*. FIG. 7 shows the back view of the outer sleeve 102, with the base extending forward from the ends of the outer sleeve walls 301*a-b*.

Figure 8:
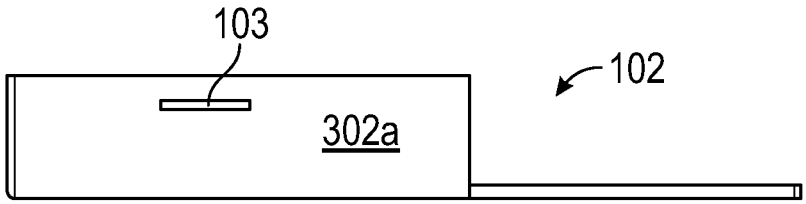
FIG. 8 shows the side view of the sliding outer sleeve of the pill sorter.

FIG. 8 shows a side view of the outer sleeve 102. The outer sleeve wall 302*a* has a slot 103 for receiving the tab 312*a*. The slot 103 is longer than the tab 312*a* allowing the outer sleeve 102 to slide relative to the trough 101 when the pill sorter 100 is assembled. Note that both sides of the outer sleeve 102 are similar, each having an outer sleeve wall 302*a-b* and a slot 103.

Figure 9:
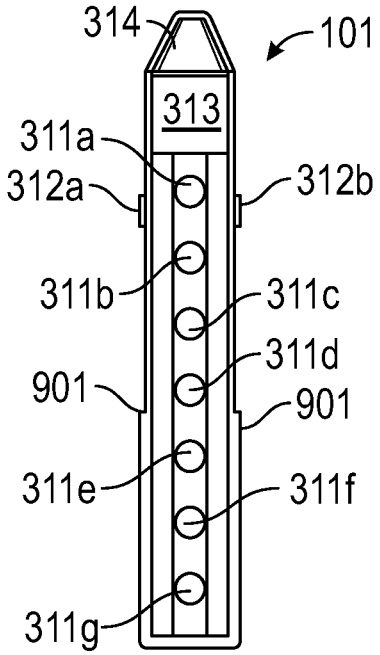
FIG. 9 shows the top view of the pill trough of the pill sorter.

FIG. 9 shows a top view of the trough 101. In some embodiments, the depth of the trough holes 311*a-g* varies based on the size of the pills. In one embodiment, the trough holes 311*a-g* are round, and in another embodiment the trough holes 311*a-g* are oblong. In still other embodiments, the trough holes 311*a-g* are the shape of the pill being dispensed. The trough holes 311*a-g* should be deep enough to hold one pill in the hole. In one embodiment, the base of the trough 101 is 2 mm thick at the trough holes 311*a-g*, the width of the trough 101 is 33 mm at the widest point and the length is 205.5 mm. The length of the trough walls is 185.5 mm, with 75.5 mm from the back to point 901, with a wall width of 5 mm, and 110 mm from point 901 to the front of the wall, with a wall width of 2 mm. The trough holes 311*a-g* are 10 mm in diameter and are 21.5 mm apart (center to center). The reservoir 313 is 25 mm in length and 22 mm wide. In this embodiment, the chute 314 is trapezoidal in shape, 25 mm on the long side and 5 mm on the short, parallel side. The two parallel sides are 28 mm apart. The chute 314 is 20 mm deep at the long side, and slops upward to a 0 mm depth at the 5 mm side. The tab 312*a-b* is 10 mm in length and located on each wall about 4 mm from the top of the wall and 60 mm from point 901.

The thickness of the trough walls changes at point 901 where the outer sleeve walls 302*a-b* end, when the pill sorter 100 is assembled, when the outer sleeve 102 is pulled back in the slot 103. The trough 101 has two tabs 312*a-b* on the outside of the thin area of the walls. The walls of the trough 101 slope downwards to the trough holes 311*a-g*. In one embodiment, the slope of the trough ends at the edge of the trough holes 311*a-g*, and begin halfway up the trough walls. At the front of the trough 101 is a reservoir 313 and a chute 314 for holding extra pills and directing them back in to the pharmacy container. In some embodiments, the bottom of the reservoir 313 is lower than the bottom of the trough around the trough holes 311*a-g*, so that the pills stay in the reservoir 313 once the trough holes 311*a-g* are full.

Figure 10:
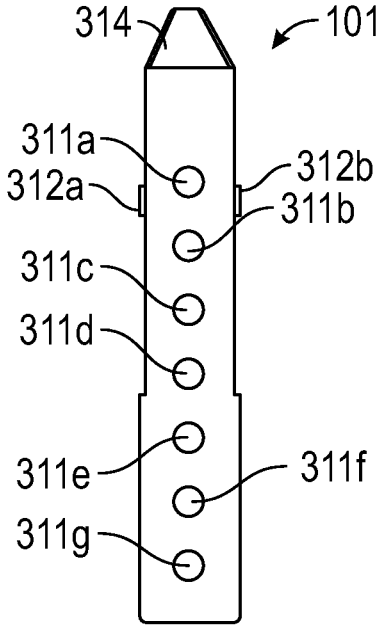
FIG. 10 shows the bottom view of the pill trough of the pill sorter.

FIG. 10 shows the bottom of the trough 101, with the trough holes 311*a-g*, and the tabs 312*a-b* visible. The upwards slope of the chute 314 can also be seen.

Figure 11:
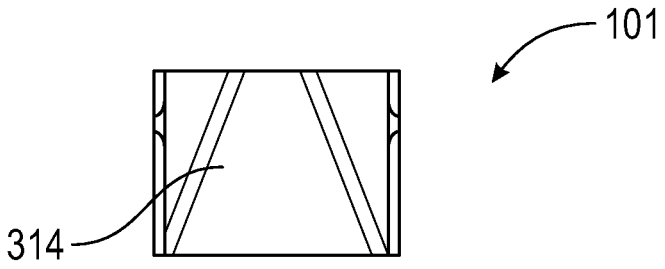
FIG. 11 shows the front view of the pill trough of the pill sorter.
Figure 12:
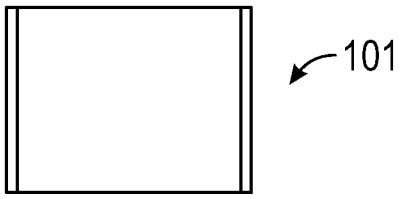
FIG. 12 shows the back view of the pill trough of the pill sorter.

FIG. 11 shows the front view of the trough 101. The chute 314 shape is visible, with the chute 314 walls drawn forward and upward to direct the excess pills when poured into the pharmacy container. FIG. 12 shows the back of the trough 101, which is a solid wall.

Figure 13:
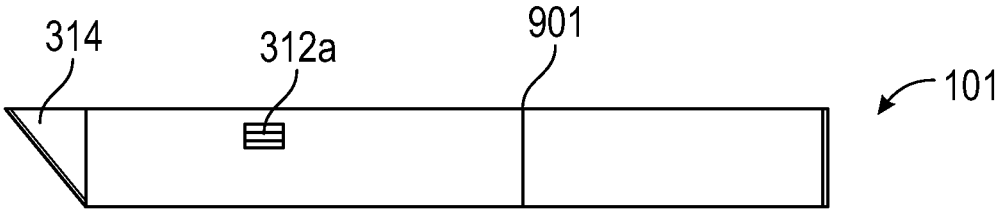
FIG. 13 shows the side view of the pill trough of the pill sorter.

FIG. 13 is one side wall of the trough 101. The opposing side is similar. Both walls have a slot 312*a-b*, and a chute 314. The wall thickness changes at the point 901.

In some embodiments, the size of each trough hole 311*a-g* is adjustable by adding two plastic curves to the trough 101, which can be adjusted with a slider on the side of the device. All curves would move together when you slide the outer sleeve 102, making all the trough holes 311*a-g* larger or smaller. Thus, only one device is needed for different pill sizes.

In other embodiments, the size of each trough hole 311*a-g* could be made adjustable by moving the two trough walls (slanted to guide pill into hole 311*a-g*), making each hole larger or smaller in one dimension. Thus, only one device is needed for different pill sizes.

In still another embodiment, chutes could be added to the bottom of each outer sleeve hole 301*a-g* that guide the pill down into the right box in the weekly pill container 104. This provides a different way to ensure that the holes are lined up correctly with the boxes in the weekly pill container 104.

In a further embodiment, a spring could be added that resists the movement of the trough 101 and the outer sleeve 102 against each other. The user squeezes the pill sorter device 100 slightly to align the trough holes 311*a-g* and the outer sleeve holes 301*a-g* and dispenses the pills. The spring goes at the end between the trough 101 and the outer sleeve 102. This has the benefit of preventing the mistaken movement the sleeve and dispensing the pills in the wrong place.

A user will take the assembled pill sorter 100, draw the outer sleeve 102 in a first direction relative to the trough 101, and place the pill sorter 100 on top of the weekly pill container 104. The user will then pour at least seven pills into the trough 101. The user will then manipulate the pill sorter 100 to cause the pills in the trough 101 to be situated in trough holes 311*a-g*. For example, the user may shake the pill sorter 100 or push the pills in the trough 101 into the trough holes 311*a-g*. Any extra pills are then pushed into the reservoir 313 or the trough 101 is tilted so that the excess pills slide into the reservoir 313. The outer sleeve 102 is then drawn in a second direction, dropping the pills into the weekly pill container 104. The outer sleeve 102 is then drawn in the first direction to close the holes, and the pill sorter 100 is separated from the weekly pill container 104. The pills in the reservoir 313 are then poured back into the pharmacy container via the chute 314. The box covers of the weekly pill container 104 are then closed. The above steps may be performed in other orders. For example, a user may pour at least seven pills into the trough 101 before placing the pill sorter 100 on top of the weekly pill container 104.

Figure 14:
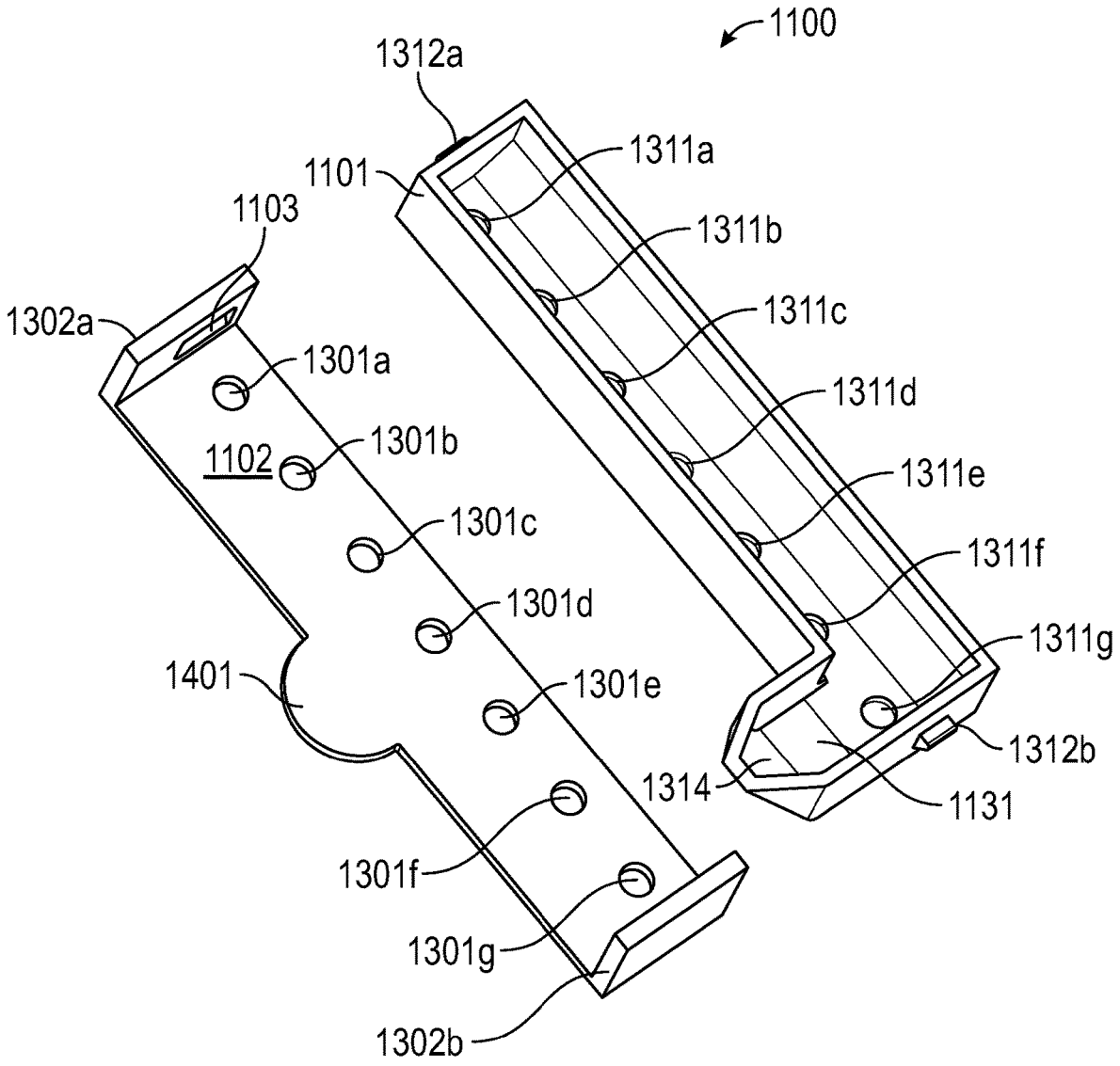
FIG. 14 shows a perspective view of an alternative embodiment of the disassembled pill sorter.

FIG. 14 shows a prospective view of an alternate embodiment of the two parts of the pill sorter 1100, roughly aligned as when assembled. The outer sleeve 1102, has two walls 1302*a-b* on the short sides of the outer sleeve 1102, running the entire width of the outer sleeve 1102. Different lengths of the side walls 1302*a-b* are possible without deviating from the inventions herein. The outer sleeve 1102 has seven outer sleeve holes 1301*a-g* in the bottom of the outer sleeve 1102. The size of these outer sleeve holes 1301*a-g* varies in various embodiments to handle different sized pills. In some embodiments, there is one size of outer sleeve holes 1301*a-g* for small pills, one size for large pills, and a third size for capsules. The outer sleeve holes 1301*a-g* are equally spaced, and the distance between outer sleeve holes 1301*a-g* is determined by the size of the boxes in the weekly pill container 104. In one embodiment, the sleeve holes 1301*a-g* are round, and in another embodiment the sleeve holes 1301*a-g* are oblong. In still other embodiments, the sleeve holes 1301*a-g* are the shape of the pill being dispensed.

A tab 1401 is available for the user to hold the outer sleeve 1102 steady as the trough 1101 moves side to side, aligning or misaligning the trough holes 1311*a-g* with the outer sleeve holes 1301*a-g*. The outer sleeve 1102 slides back and forth as two tabs 1312*a-b* in the end walls of the trough 1101 slide in two slots 1103 in the outer sleeve walls 1302*a-b* (the second slot 1103 is not visible in this drawing), In the embodiment shown in FIG. 14, the position of the reservoir 1131 is located in the side wall of the trough 1101, with one of the trough side walls stopping short of the end, leaving an opening for excess pills to drop into the reservoir 1131. The other side of the reservoir 1131 has the chute 1314.

While the present disclosure has been presented above with respect to the described and illustrated embodiments of the pill dispenser 100, it is to be understood that the disclosure is not to be limited to those alternatives and described embodiments. Accordingly, reference should be made primarily to the following claims rather than the forgoing description to determine the scope of the disclosure.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A sorting apparatus for pills, the sorting apparatus comprising:

a trough with seven trough holes on a trough bottom of the trough, said trough having two trough side walls and an open trough top, wherein the trough holes are sized to hold the pills and the trough holes are spaced to align with boxes in a weekly pill container; and an outer sleeve with seven sleeve holes, wherein the outer sleeve is attached to the trough such that the outer sleeve slides along the trough bottom, and the seven sleeve holes are offset from the seven trough holes in a first position and aligned with the seven trough holes in a second position, wherein the two trough side walls include tabs on an outside of the two trough side walls and the outer sleeve includes two outer sleeve walls where the two outer sleeve walls include slots in the two outer sleeve walls, where the tabs slide in the slots.

2. The sorting apparatus of claim 1 wherein the trough side walls are sloped from a point on the trough walls to an edge of the trough holes.

3. The sorting apparatus of claim 1 wherein the trough also includes a reservoir at one end of the trough holes, wherein the reservoir is between the two trough side walls.

4. The sorting apparatus of claim 3 wherein the trough also includes a chute attached to the reservoir at the trough walls and the trough bottom, where walls of the chute angle together and a chute bottom raises upwards.

5. The sorting apparatus of claim 1 wherein the trough also includes a reservoir at one side of the trough, near an end hole.

6. The sorting apparatus of claim 1 wherein a back end of the trough is an end wall perpendicular and connected to the two trough side walls.

7. The sorting apparatus of claim 1 wherein the outer sleeve further includes alignment tabs beneath the sorting apparatus, said alignment tabs arranged to align the sorting apparatus with the weekly pill container.

8. The sorting apparatus of claim 1 further including a spring connecting the trough and the outer sleeve.

9. A method for sorting pills, the method comprising:

drawing an outer sleeve in a first direction relative to a trough of an assembled pill sorter wherein the trough includes two trough side walls that include tabs on an outside of the two trough side walls and the outer sleeve includes two outer sleeve walls where the two outer sleeve walls include slots in the two outer sleeve walls, where the tabs slide in the slots when drawn;

placing the pill sorter on top of a weekly pill container;

pouring at least seven pills into the trough from a pharmacy container;

manipulating the pill sorter until at least one pill in the trough falls into at least one trough hole located in a bottom of the trough;

drawing the outer sleeve in a second direction, dropping the pills into the weekly pill container; and separating the pill sorter from the weekly pill container.

10. The method of claim 9 further comprising pushing excess pills into a reservoir.

11. The method of claim 9 further comprising tilting the pill sorter so that excess pills slide into a reservoir.

12. The method of claim 9 wherein the outer sleeve is drawn in the first direction by a spring.

13. The method of claim 9 wherein the outer sleeve is drawn relative to the trough along a slot in side walls of the outer sleeve that hold a tab connected to walls of the trough.

14. The method of claim 9 wherein the outer sleeve is drawn relative to the trough along a slot in side walls of the trough that hold a tab connected to walls of the outer sleeve.

15. A sorting system for pills, the sorting comprising:

a weekly pill container with seven boxes; and a pill sorter, the pill sorter comprising:

a trough with seven trough holes on a trough bottom of the trough, said trough having two trough side walls and an open trough top, wherein the trough holes are sized to hold the pills and the trough holes are spaced to align with the seven boxes in the weekly pill container; and an outer sleeve with seven sleeve holes, wherein the outer sleeve is attached to the trough such that the outer sleeve slides along the trough bottom, and the seven sleeve holes are offset from the seven trough holes in a first position and aligned with the seven trough holes in a second position, wherein the two trough side walls include tabs on an outside of the two trough side walls and the outer sleeve includes two outer sleeve walls where the two outer sleeve walls include slots in the two outer sleeve walls, where the tabs slide in the slots.

16. The sorting system of claim 15 wherein the outer sleeve further includes alignment tabs beneath the pill sorter, said alignment tabs arranged to align the pill sorter with the weekly pill container.

* * * * *